US009745991B2

(12) United States Patent
Baillargeon et al.

(10) Patent No.: US 9,745,991 B2
(45) Date of Patent: Aug. 29, 2017

(54) SLOTTED WASHER PAD FOR STAGE IMPELLERS OF SUBMERSIBLE CENTRIFUGAL WELL PUMP

(71) Applicant: Baker Hughes Incorporated, Houston, TX (US)

(72) Inventors: David S. Baillargeon, Claremore, OK (US); David F. McManus, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 442 days.

(21) Appl. No.: 14/559,336

(22) Filed: Dec. 3, 2014

(65) Prior Publication Data

US 2015/0167686 A1 Jun. 18, 2015

Related U.S. Application Data

(60) Provisional application No. 61/917,703, filed on Dec. 18, 2013.

(51) Int. Cl.

| | |
|---|---|
| ***F04D 29/041*** | (2006.01) |
| ***F04D 13/08*** | (2006.01) |
| ***F01D 1/06*** | (2006.01) |
| ***F04D 13/10*** | (2006.01) |
| ***F04D 29/44*** | (2006.01) |
| *F04D 1/06* | (2006.01) |

(52) U.S. Cl.

CPC ..... *F04D 29/0413* (2013.01); *F04D 13/10* (2013.01); *F04D 29/445* (2013.01); *F04D 1/06* (2013.01)

(58) Field of Classification Search

CPC ..... F04D 1/066; F04D 13/10; F04D 29/2266; F04D 29/426; F04D 29/445; F04B 47/00; F05B 2240/52; Y10S 415/901

See application file for complete search history.

(56) References Cited

U.S. PATENT DOCUMENTS

| | | | |
|---|---|---|---|
| 735,692 | A | 3/1903 | Watson |
| 1,117,861 | A | 11/1914 | Krogh |
| 1,137,849 | A | 5/1915 | Edwards |
| 1,929,077 | A | 10/1933 | Rose |
| 2,662,486 | A | 12/1953 | Hillger |
| 3,477,384 | A | 11/1969 | Hlinka |
| 3,782,860 | A | 1/1974 | DeLancey et al. |

(Continued)

*Primary Examiner* — Nathaniel Wiehe
*Assistant Examiner* — Brian O Peters
(74) *Attorney, Agent, or Firm* — Bracewell LLP; James E. Bradley

(57) ABSTRACT

A submersible pump assembly includes a centrifugal pump driven by a motor. The pump has a number of stages, each of the stages having a diffuser and an impeller. An upthrust washer is located between a diffuser upthrust surface and an impeller upthrust surface. Balance holes extend from an inlet on an upper side of the impeller to an outlet within one of the impeller passages. The upthrust washer overlies the inlets while the impeller is in the upthrust position. Slots are located at an interface between the upthrust washer and the impeller upthrust surface. Each of the slots registers with the inlet of one of the balance holes to allow fluid flow into the inlets of the balance holes while the impeller is in the upthrust position.

20 Claims, 5 Drawing Sheets

(56) References Cited

U.S. PATENT DOCUMENTS

| | | | | |
|---|---|---|---|---|
| 4,838,758 | A * | 6/1989 | Sheth | F04D 13/10 415/140 |
| 4,872,808 | A | 10/1989 | Wilson | |
| 5,628,616 | A | 5/1997 | Lee | |
| 6,106,224 | A * | 8/2000 | Sheth | F04D 29/0413 415/104 |
| 7,648,332 | B2 | 1/2010 | Eslinger et al. | |
| 7,841,826 | B1 | 11/2010 | Phillips | |
| 2011/0027077 | A1 * | 2/2011 | Brunner | F04D 13/10 415/198.1 |
| 2011/0255951 | A1 * | 10/2011 | Song | F04D 29/041 415/1 |

* cited by examiner

SLOTTED WASHER PAD FOR STAGE IMPELLERS OF SUBMERSIBLE CENTRIFUGAL WELL PUMP

CROSS REFERENCE TO RELATED APPLICATION

This application claims priority to provisional application Ser. No. 61/917,703, filed Dec. 18, 2013.

FIELD OF THE DISCLOSURE

This disclosure relates in general to centrifugal well pumps and in particular to a pump stage having a thrust washer pad with slots to prevent the thrust washer from blocking flow into impeller balance holes during upthrust conditions.

BACKGROUND

Many oil wells have submersible centrifugal pumps for pumping well fluid. A motor operatively couples to the pump to drive the pump. The pump has a large number of stages, each stage having an impeller and a diffuser. The impeller has impeller flow passages that extend upward and outward to propel fluid into diffuser flow passages extending upward and inward.

The impellers are free to move axially a short distance relative to the diffusers in response to downthrust and upthrust imposed on the impellers. Downthrust acts in an upstream direction on the impeller, while upthrust acts in a downstream direction on the impeller. Each diffuser has a downward facing upthrust surface located above an upward facing upthrust surface on the impeller. An upthrust washer located between the diffuser upthrust surface and the impeller upthrust surface transfers the upthrust from the impeller to the diffuser. Impellers and diffusers also have downthrust surfaces and downthrust washers.

A balance ring on an upper side of the impeller is in rotating engagement with a cavity wall on the lower side of the diffuser. Some of the well fluid discharged from the impeller passages escapes into the diffuser cavity above the impeller through a small clearance between the balance ring and the cavity wall. The fluid that enters the diffuser cavity is normally at a higher pressure than the fluid within the impeller passages, creating a higher pressure zone in the diffuser cavity that acts on the impeller. Many impellers have balance holes extending from the upper side of the impeller into the impeller flow passages in communication with the well fluid flowing into the diffuser cavity. The balance holes allow some of the higher pressure fluid in the diffuser cavity to flow or drain through the balance holes into the impeller passages, reducing the pressure in the diffuser cavity.

In some designs the upthrust washer will be located above the inlets of the balance holes. During full upthrust, the upthrust washer will be squeezed between the impeller upthrust surface and the diffuser upthrust surface. Thus, while the impeller is in a full upthrust condition, the upthrust washer will block flow from the diffuser cavity down through the balance holes.

SUMMARY

The centrifugal pump of this disclosure has a drive shaft extending along a longitudinal axis. A motor operatively coupled to the pump rotates the drive shaft. The pump has a plurality of stages, each of the stages comprising and impeller and a diffuser. The impeller mounts to the drive shaft for rotation therewith and is free to move axially relative to the shaft between downthrust and upthrust positions. The impeller has a plurality of vanes, defining impeller passages extending upward and outward from a lower side of the impeller. An upward facing thrust surface on an upper side of the impeller is positioned below a downward facing thrust surface of the diffuser.

A plurality of balance holes in the impeller extend from the upper side of the impeller downward into the impeller passages. A thrust washer locates between the upward facing thrust surface and the downward facing thrust surface. The thrust washer overlies the balance holes and is in engagement with both the upward facing thrust surface and the downward facing thrust surface while the impeller is in the upthrust position, to transfer upthrust from the impeller to the diffuser. At least one communication path is located at an interface between the thrust washer and the upward facing thrust surface to allow fluid flow through the balance holes during the upthrust position.

The communication path may comprise a plurality of radially extending slots in the interface. Each of the slots registers with an upper end of one of the balance holes. Each of the slots has a flow area at least equal to a flow area of each of the balance holes.

In the preferred embodiment, the slots are in the thrust surface of the impeller and extend outward from the balance holes. Each slot may extend along a radial line from an upper end of one of the balance holes.

The upper side of the impeller may have an elevated pedestal having an upper side that defines the thrust surface of the impeller. The slots may be formed in the pedestal, each joining an upper end of one of the balance holes and extending outward to the periphery of the pedestal. Each of the slots may have a pair of outward extending side walls, a closed inner end and an open outer end.

The impeller may have a pedestal with an outer periphery formed around the hub. The upper side of the pedestal defines the thrust surface of the impeller. Each of the slots joins an upper end of one of the balance holes and has a pair of side walls extending outward from the hub to the periphery of the pedestal. Each of the slots is open at the periphery of the pedestal. The upper end of each of the balance holes is at an elevation below the upper side of the pedestal.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1:
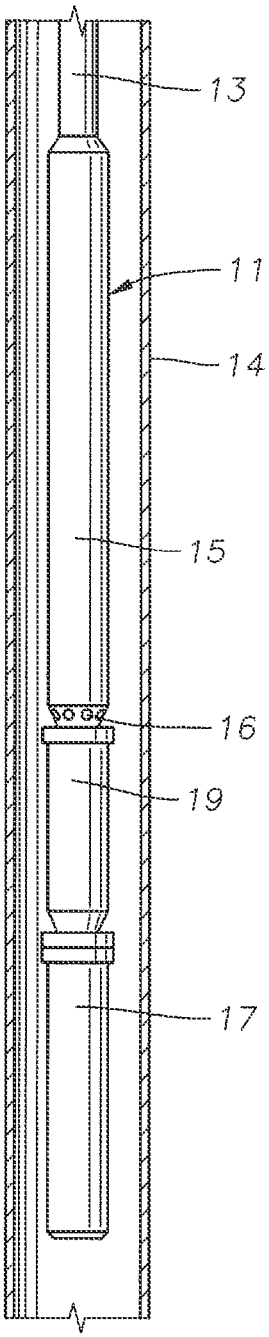
FIG. 1 is a side view of an electrical submersible pump assembly in accordance with this disclosure and installed in a well.

The present disclosure will now be described more fully hereinafter with reference to the accompanying drawings in which embodiments are shown. The present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, electrical submersible pump assembly (ESP) 11 is illustrated as being supported on production tubing 13 extending into a well having a casing 14. Alternately, ESP 11 could be supported by other structure, such as coiled tubing. ESP 11 could also be mounted outside of a well to boost the pressure of well fluid flowing to it. ESP 11 includes several modules, one of which is a centrifugal pump 15 that has an intake 16 for drawing in well fluid. Another module is an electrical motor 17, which drives pump 15 and is normally a three-phase AC motor. A third module comprises a protective member or seal section 19 coupled between pump 15 and motor 17. Seal section 19 has components, such a bellows or bag, to reduce a pressure differential between dielectric lubricant contained in motor 17 and the pressure of the well fluid on the exterior of ESP 11. Intake 16 may be located in an upper portion of seal section 19 or on a lower end of pump 15.

ESP 11 may also include other modules, such as a gas separator for separating gas from the well fluid prior to the well fluid flowing into pump 15. The various modules may be shipped to a well site apart from each other, then assembled with bolts or other types of fasteners.

Figure 2:
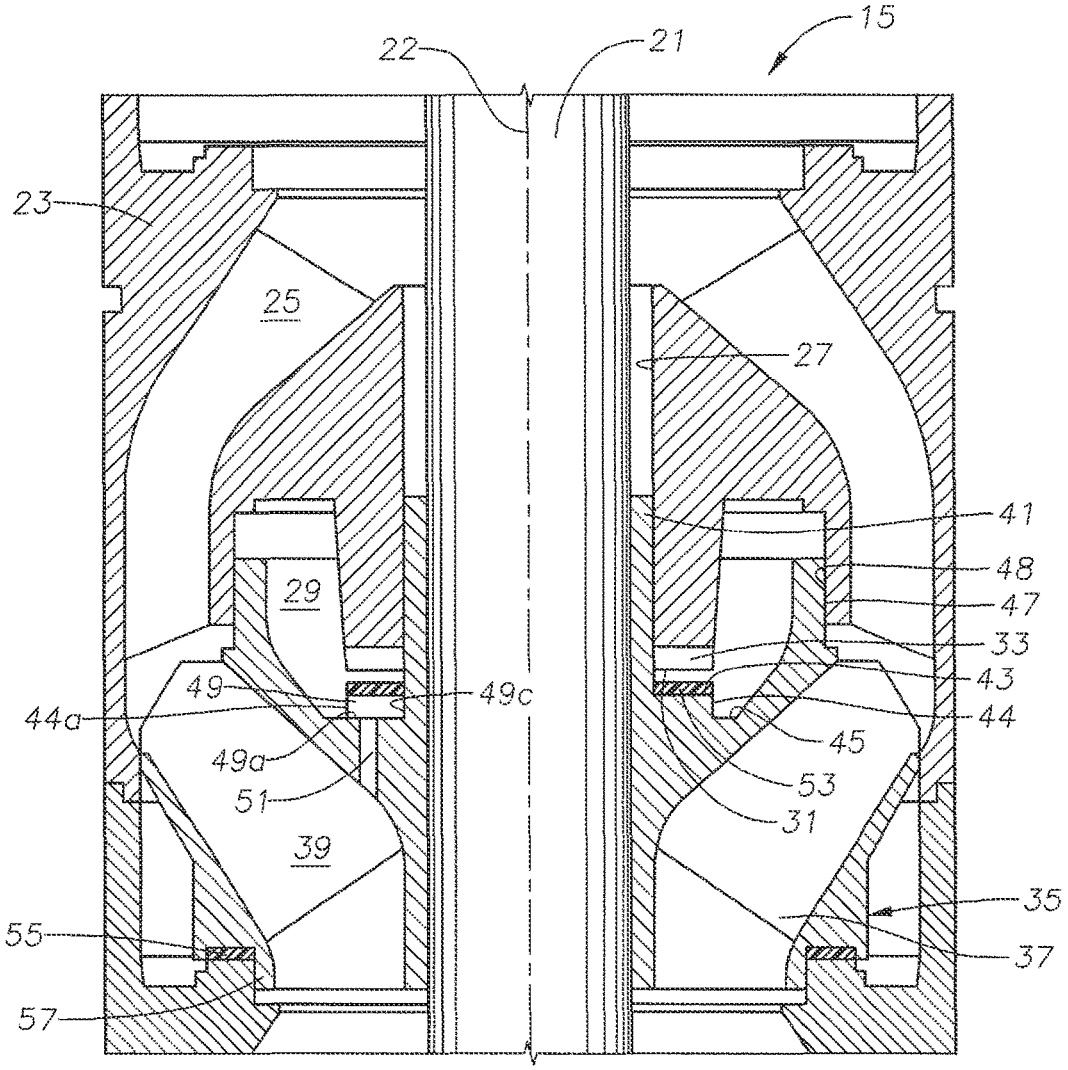
FIG. 2 is a sectional view of one pump stage of the pump of FIG. 1, showing the impeller during downthrust conditions.

Referring to FIG. 2, pump 15 has a large number of pump stages with a drive shaft 21 extending through them along a longitudinal axis 22. Motor 17 (FIG. 1) rotates drive shaft 21, which normally comprises more than one section joined to other sections with splined ends. Each pump stage has a diffuser 23 stationarily mounted in a cylindrical housing (not shown) of pump 15. Diffusers 23 are stacked on one another. Diffuser 23 has diffuser passages 25 that extend upward and inward relative to axis 22. The terms "upward" and "downward" are used only for convenience, since pump 15 may be operated in inclined or horizontal orientations. Diffuser 23 is illustrated as a mixed flow stage diffuser, but it could alternately be a radial flow type. In a radial flow type, passages 25 do not extend upward and inward, rather they are generally in a plane perpendicular to axis 22.

Diffuser 23 has an axial bore 27 through which shaft 21 passes. Diffuser 23 has an annular downward facing cavity 29. A downward facing diffuser upthrust surface 31 extends between diffuser bore 27 and the inner diameter of diffuser cavity 29. Diffuser upthrust surface 31 is flat and in a plane perpendicular to axis 22.

Figure 4:
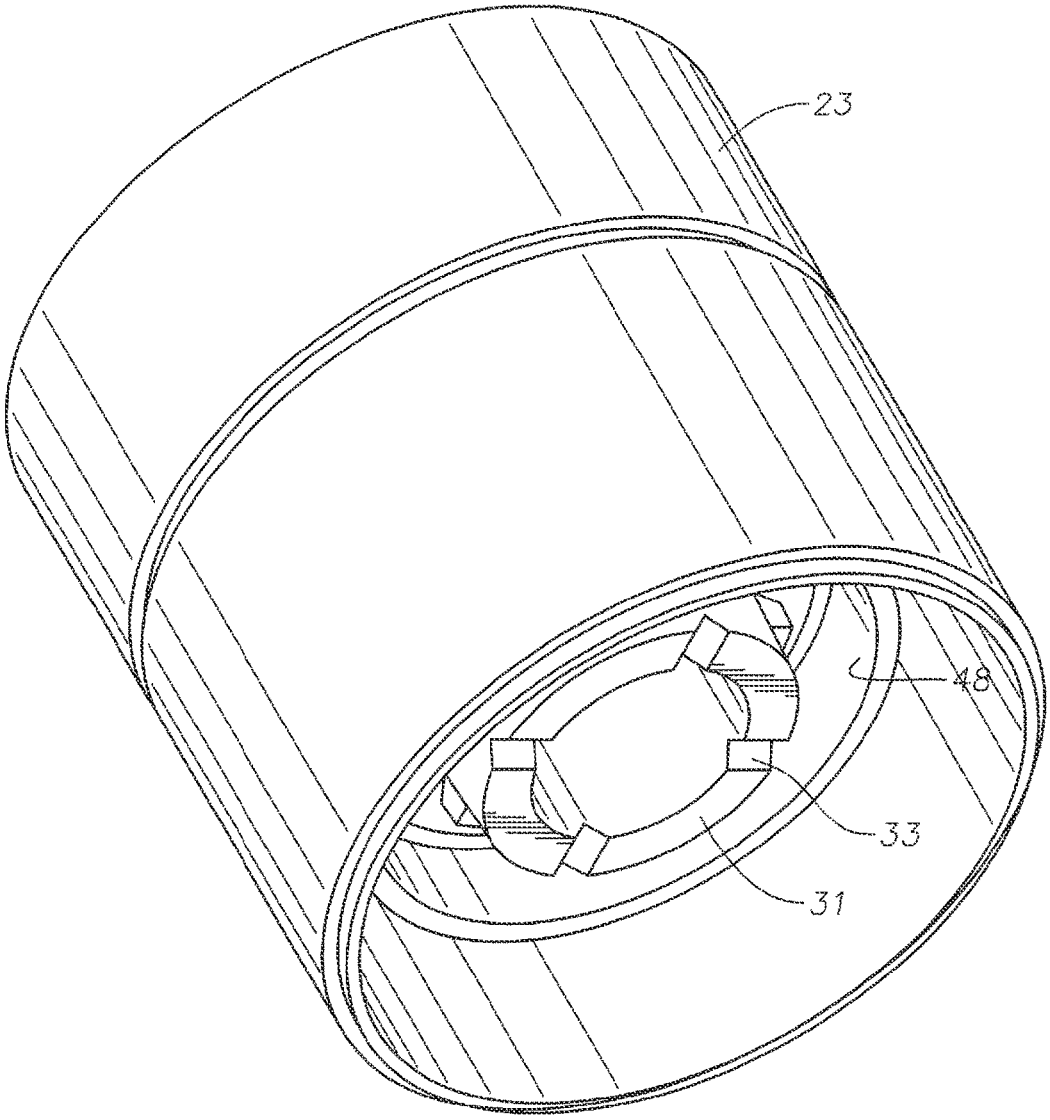
FIG. 4 is a perspective view of a lower portion of a diffuser of the pump stage of FIG. 2.

As shown in FIG. 4, a plurality of grooves 33 optionally may be formed in diffuser thrust surface 31. In this example, each groove 33 extends radially outward from diffuser bore 27 to the inner diameter of diffuser cavity 29. Each groove 33 may be V-shaped in cross-sectional configuration or have other configurations. The V-shape of each groove 33 is defined by two upward sloping surfaces joining each other at an apex centered between side edges of each groove 33.

Referring again to FIG. 2, each stage has an impeller 35 that is keyed to shaft 21 for rotation in unison. Impeller 35 is free to move axially a short distance relative to shaft 21 and diffuser 23. Impeller 35 has a plurality of vanes 37 that define impeller passages 39. For the mixed flow type illustrated, impeller passages 39 extend upward and outward to discharge well fluid into the lower ends of diffuser passage 25. Impeller 35 has a central cylindrical hub 41 with a bore that closely receives shaft 21 and extends upward into part of diffuser bore 27. Hub 41 slidingly engages diffuser bore 27 while impeller 35 rotates. Hub 41 is illustrated as being integrally formed with impeller 35, but at least part of it could be separate and formed of a more abrasion resistant material, such as tungsten carbide.

Impeller 35 has an upward facing upthrust shoulder or surface 43 positioned below diffuser upthrust surface 31. Impeller upthrust surface 43 is in a plane perpendicular to axis 22 and extends radially outward from the exterior cylindrical side wall of hub 41. Impeller upthrust surface 43 is located on the upper end of a cylindrical pedestal 44, thus is raised a short distance above an annular upward facing central portion 45 on the upper side of impeller 35. Pedestal 44 has a cylindrical outer wall, periphery or perimeter 44*a* extending upward from central portion 45, which may be flat. Impeller 35 has an upper cylindrical balance ring 47 that fits within diffuser cavity 29. Balance ring 47 slidingly engages an inward facing cylindrical wall 48 that defines an outer diameter of diffuser cavity 29 while impeller 35 rotates.

Figure 5:
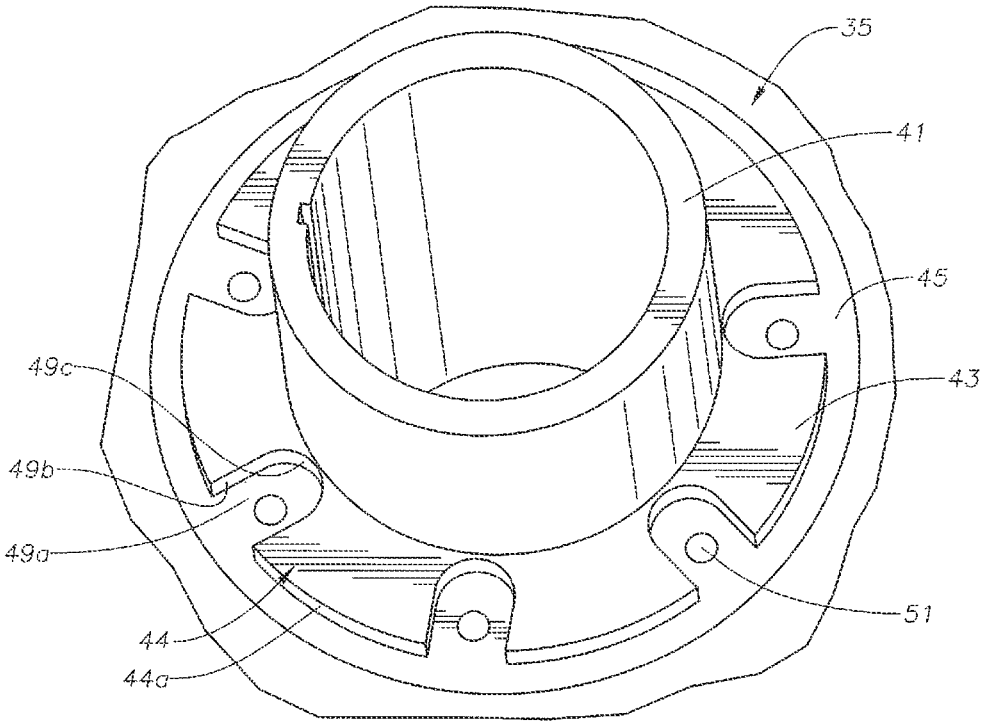
FIG. 5 is a partial perspective view of an upper portion of the impeller of the pump stage of FIG. 3.

As shown also in FIG. 5, radially extending slots 49 are formed in thrust pedestal 44. Each slot 49 has a base or lower side 49*a* that may be flush with impeller upper central portion 45. Each slot 49 has two side walls 49*b* extending upward from lower side 49*a* and facing each other. Side walls 49*b* may be parallel to each other and extend outward from a curved inner junction 49*c* to the cylindrical outer wall 44*a* of thrust pedestal 44. Curved junction 49*c* is approximately at an outer diameter portion of hub 41. Each slot 49 is open at the outer wall 44*a* of thrust pedestal 44. Slots 49 are formed in impeller upward facing thrust surface 43, dividing upward facing thrust surface 43 into separate arcuate segments.

Alternately, slot base 49*a* need not be flush with impeller upper central portion 45. Also, side walls 49*b* could be non parallel. In addition, thrust pedestal 44 is shown as being integrally formed with the body of impeller 35, but it could be a separate member.

As shown in FIGS. 2 and 5, a plurality of balance holes 51 are formed in impeller 35. Each balance hole 51 extends upward from one of the impeller passage 35 to an inlet on slot lower side 49*a*. The upper end or inlet of each balance hole 51 may be centered between slot side walls 49*b*. Each balance hole 51 is in fluid communication with impeller upper central portion 45 through one of the open slots 49. The diameter of balance hole 51 is normally less than the distance between slot side walls 49*b*.

An upper thrust washer 53 is sandwiched between upward facing thrust surface 43 and downward facing thrust surface 31. Upper thrust washer 53 is typically formed of a phenolic material and transfers upthrust from impeller 35 to diffuser 23. Thrust washer 53 optionally may be bonded by an adhesive to impeller upward facing thrust surface 43; if so, thrust washer 53 will always rotate in unison with impeller 35. Other than its central opening that receives hub 41, thrust washer 53 is free of apertures. Thrust washer 53 overlies slots 49, defining a closed upper side of each slot 49. The cross-sectional dimension or flow area of each slot 49 when thrust washer 53 is placed on thrust surface 43 is preferably equal or greater than the flow area of each balance hole 51.

Typically a lower thrust washer 55 is located between a downward facing thrust surface of impeller 35 and an upward facing thrust surface of the diffuser 23 located immediately below impeller 35. Also, impeller 35 will normally have a cylindrical lower skirt 57 that extends into and slidingly engages a cylindrical surface of the diffuser 23 located immediately below.

In operation, shaft 21 rotates impellers 35. Well fluid from the next lower diffuser 23 flows into the lower ends of impeller passages 39. Impeller 35 discharges the well fluid at a higher velocity into the lower ends of diffuser passages 25. Often impeller 35 will be in a downthrust position, which is shown in FIG. 2. The discharge of the well fluid from impeller passage 39 creates an upstream or downward directed force. Lower thrust washer 55 transfers the downthrust to the next upstream or lower diffuser 23. Upper thrust washer 55 will be spaced below diffuser downward facing thrust surface 31. Some fluid will escape from the discharge area of impeller 35 though the small clearance between balance ring 47 and cavity wall 48 into diffuser cavity 29. Normally, the well fluid in diffuser cavity 29 will be at a higher pressure than the well fluid within impeller passages 39. Balance holes 51 communicate well fluid from cavity 29 back into the well fluid flowing through impeller passages 39. Balance holes 51 thus recirculate some well fluid entering cavity 29 from the clearance between balance ring 47 and cavity wall 48 back into impeller passages 39, which reduces the pressure within diffuser cavity 29.

Figure 3:
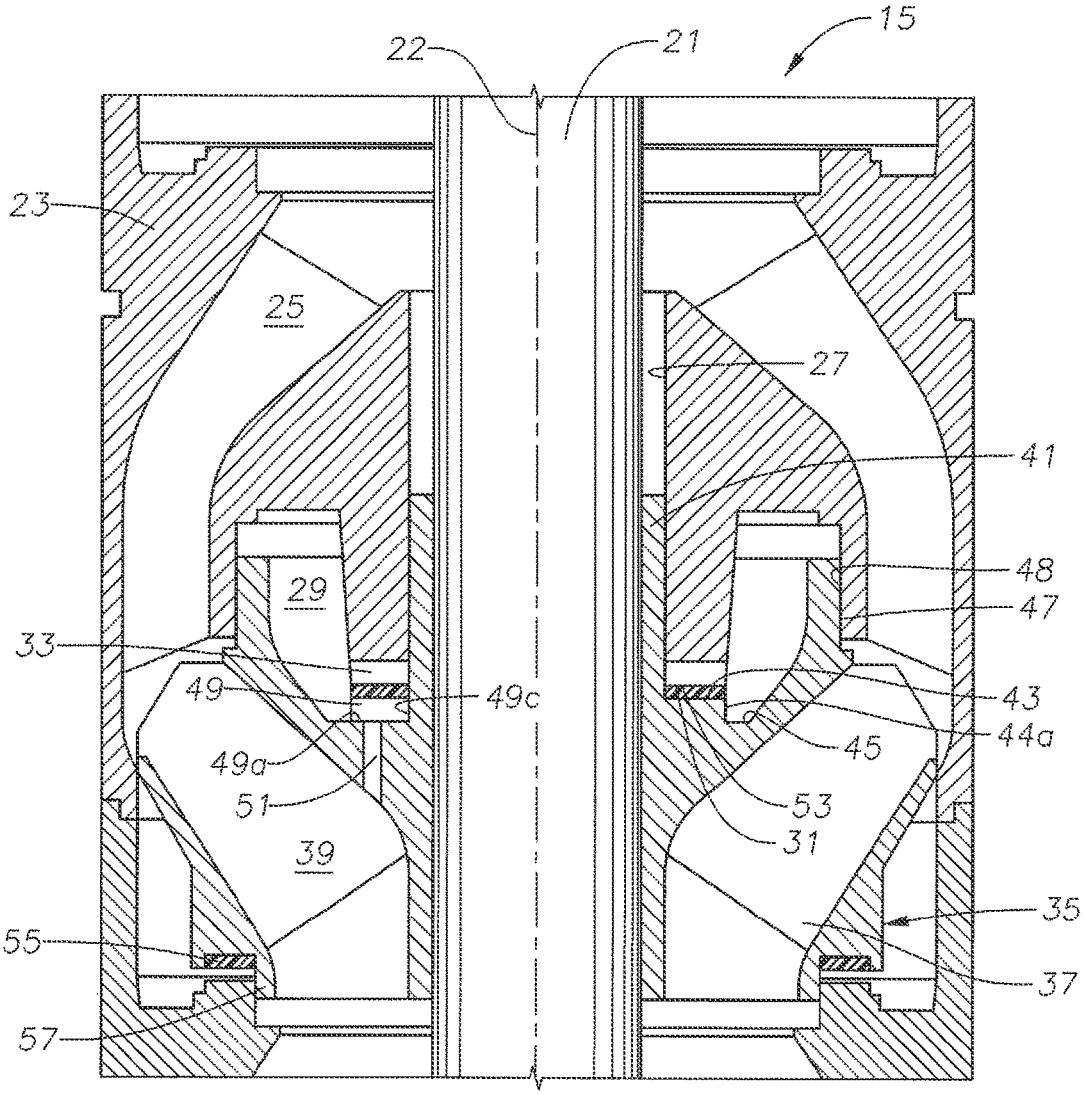
FIG. 3 is a sectional view of the pump stage of FIG. 2, shown during upthrust conditions.

Upthrust conditions occur at start up and other times, resulting in impeller 35 being forced upward to the upthrust position shown in FIG. 3. In this position, impeller 35 moves upward relative to shaft 21 and diffuser 23, causing upper thrust washer 53 to engage diffuser downward facing thrust surface 31. Thrust washer 53 will transfer upthrust from impeller 35 to the next upward diffuser 23. Even though tightly compressed between thrust surfaces 31 and 43, thrust washer 53 does not block balance holes 51. Slots 49 allow communication of well fluid between impeller upper central portion 45 and impeller passages 39.

Although slots 49 are illustrated in thrust pedestal 44, optionally they could be formed in thrust washer 53 if thrust washer 53 is made thicker. In that instance, thrust pedestal 44 would not be required.

While the invention has been shown in only one of its forms, it should be apparent to those skilled in the art that it is not so limited but is susceptible to various changes.

The invention claimed is:

1. A submersible pump assembly, comprising:

a centrifugal pump having a drive shaft extending along a longitudinal axis;

a motor operatively coupled to the pump for rotating the drive shaft;

the pump having a plurality of stages, each of the stages comprising:

an impeller mounted to the drive shaft for rotation therewith and free to move axially relative to the shaft between downthrust and upthrust positions;

a diffuser having a downward facing thrust surface;

the impeller having a plurality of vanes, defining impeller passages extending upward and outward from a lower side of the impeller;

an upward facing thrust surface on an upper side of the impeller positioned below the downward facing thrust surface of the diffuser;

a plurality of balance holes in the impeller, each extending from the upper side of the impeller into one of the impeller passages;

a thrust washer located between the upward facing thrust surface and the downward facing thrust surface, the thrust washer overlying the balance holes and being in engagement with both the upward facing thrust surfaces and the downward facing thrust surfaces while the impeller is in the upthrust position to transfer upthrust from the impeller to the diffuser; and at least one communication path at an interface between the thrust washer and the upward facing thrust surface to allow fluid flow through the balance holes during the upthrust position.

2. The assembly according to claim 1, wherein the communication path comprises:

a plurality of radially extending slots in the interface.

3. The assembly according to claim 1, wherein the communication path comprises:

a plurality of radially extending slots in the interface, each of the slots registering with an upper end of one of the balance holes; and each of the slots has a flow area at least equal to a flow area of each of the balance holes.

4. The assembly according to claim 1, wherein the communication path comprises:

a plurality of slots in the thrust surface of the impeller, each of the slots extending outward from one of the balance holes relative to the axis.

5. The assembly according to claim 1, wherein the communication path comprises:

a plurality of slots in the thrust surface of the impeller, each of the slots extending radially outward from an upper end of one of the balance holes.

6. The assembly according to claim 1, wherein:

the upper side of the impeller comprises an elevated pedestal having an upper side that defines the thrust surface of the impeller, the pedestal having an outer periphery; and wherein the communication path comprises:

a plurality of slots formed in the pedestal, each of the slots joining an upper end of one of the balance holes and extending outward to the periphery of the pedestal.

7. The assembly according to claim 1, wherein:

the impeller has a cylindrical hub through which the shaft extends;

the balance holes have upper ends spaced around the hub that are at an elevation below the thrust surface of the impeller; and the communication path comprises a plurality of slots formed in the upper side of the impeller, each registering with the upper end of one of the balance holes and extending radially outward from the hub.

8. The assembly according to claim 1, wherein:

the impeller has a cylindrical hub through which the shaft extends;

an upper end of each of the balance holes is spaced radially outward from the hub;

the communication path comprises a plurality of slots formed in the upper side of the impeller, each of the slots registering with the upper end of one of the balance holes and extending outward from the hub; and each of the slots has a pair of outward extending side walls, a closed inner end and an open outer end.

9. The assembly according to claim 1, wherein:

the impeller has a cylindrical hub through which the shaft extends;

the upper side of the impeller comprises an elevated pedestal surrounding the hub and having an upper side that defines the thrust surface of the impeller, the pedestal having an outer periphery; wherein the communication path comprises:

a plurality of slots formed in the pedestal, each of the slots joining an upper end of one of the balance holes and having a pair of side walls extending outward to the periphery of the pedestal; wherein each of the slots is open at the periphery of the pedestal; and the upper ends of the balance holes are at an elevation below the upper side of the pedestal.

10. A submersible pump assembly, comprising:

a centrifugal pump having a drive shaft extending along a longitudinal axis;

a motor operatively coupled to the pump for rotating the drive shaft;

the pump having a plurality of stages, each of the stages comprising:

a diffuser having a diffuser upthrust surface;

an impeller having a cylindrical hub through which the shaft extends, the impeller having plurality of vanes defining impeller flow passages, the impeller being free to move axially relative to the shaft between a downthrust position and an upthrust position;

an impeller upthrust surface on the impeller spaced axially from the diffuser upthrust surface;

an upthrust washer located between the diffuser upthrust surface and the impeller upthrust surface, the upthrust washer transferring upthrust from the impeller upthrust surface to the diffuser upthrust surface while the impeller is in the upthrust position;

a plurality of balance holes in the impeller, each having an outlet within one of the impeller passages and having an inlet, the upthrust washer overlying the inlets while the impeller is in the upthrust position; and a plurality of slots at an interface between the upthrust washer and the impeller upthrust surface, each of the slots registering with the inlet of one of the balance holes to allow fluid flow into the inlets of the balance holes while the impeller is in the upthrust position.

11. The assembly according to claim 1, wherein:

each of the slots has a flow area at least equal to a flow area of each of the balance holes.

12. The assembly according to claim 10, wherein each of the slots is formed in the impeller upthrust surface.

13. The assembly according to claim 10, wherein:

the impeller upthrust surface is located on an elevated pedestal having an outer periphery; and each of the slots extends radially outward through the pedestal from the inlet of one of the balance holes to the periphery of the pedestal.

14. The assembly according to claim 10, wherein:

the slots are spaced around the hub and extend through the impeller upthrust surface, dividing the impeller upthrust surface into arcuate segments.

15. The assembly according to claim 10, wherein:

the slots are spaced around the hub and extend through the impeller upthrust surface, dividing the impeller upthrust surface into arcuate segments; and each of the slots has a base and a pair of sidewalls extending between the base and the impeller upthrust surface; and the inlets of the balances holes are located in the bases of the slots axially spaced from the impeller thrust surface by an axial depth of each of the slots.

16. A submersible pump assembly, comprising:

a centrifugal pump having a drive shaft extending along a longitudinal axis;

a motor operatively coupled to the pump for rotating the drive shaft;

the pump having a plurality of stages, each of the stages comprising:

a diffuser having a plurality of diffuser flow passages extending upward and inward, the diffuser having a downward facing diffuser upthrust surface and an inward facing cylindrical cavity wall on a lower side, defining a lower cavity that encircles the diffuser upthrust surface;

an impeller having a hub that receives the drive shaft for rotation therewith, the impeller having a plurality of vanes, defining impeller passages extending upward and outward from a lower side of the impeller that impart flowing fluid to the diffuser flow passages, the impeller having a balance ring on an upper side in sliding engagement with the cavity wall of the diffuser;

a pedestal surrounding the hub and having an outer periphery, the pedestal having an upward facing impeller upthrust surface spaced below the diffuser upthrust surface;

a plurality of slots extending radially from the hub through the pedestal to the periphery of the pedestal; and a plurality of balance holes in the impeller, each extending axially from one of the impeller passages to the one of the slots to allow fluid that flows past the balance ring and cavity wall into the cavity to flow from the cavity through the slots and balance holes into the impeller passages.

17. The assembly according to claim 16, further comprising:

an upthrust washer located between the impeller upthrust surface and the diffuser upthrust surface for transferring upthrust from the impeller to the diffuser.

18. The assembly according to claim 16, wherein:

each of the slots extends through the impeller upthrust surface, dividing the impeller upthrust surface into separate arcuate segments.

19. The assembly according to claim 16, wherein:

each of the slots has a base and a pair of sidewalls extending from the base to the impeller upthrust surface;

each of the balance holes extends from one of the impeller passages to the base of one of the slots; and the upthrust washer overlies the base of each of the slots.

20. The assembly according to claim 16, wherein:

each of the slots has a base and a pair of parallel, radially extending sidewalls extending from the base to the impeller upthrust surface;

each of the balance holes extends from one of the impeller passages to the base of one of the slots; and the upthrust washer overlies the base of each of the slots.

* * * * *